US005673942A

United States Patent [19]

Despointes

[11] Patent Number: 5,673,942

[45] Date of Patent: Oct. 7, 1997

[54] CONTAINER FOR NOTEPAPER

[76] Inventor: Xavier Huyghues Despointes, Lot Aubéry - Plaisance, 97122 Baie Mahault, Guadeloupe, France

[21] Appl. No.: 495,920

[22] Filed: Jun. 28, 1995

[51] Int. Cl.[6] ..... B42D 17/00

[52] U.S. Cl. ..... 281/44; 281/45; 281/51

[58] Field of Search ..... 281/15.1, 28, 44, 281/51, 45; 402/70; 40/371; 224/277; 206/425

[56] References Cited

U.S. PATENT DOCUMENTS

| | | | |
|---|---|---|---|
| 2,488,007 | 11/1949 | Dovitch . | |
| 2,590,618 | 3/1952 | Hodkin | 281/44 |
| 2,806,715 | 9/1957 | Smith | 281/44 |
| 3,197,062 | 7/1965 | Day et al. . | |
| 5,174,607 | 12/1992 | Hill | 281/44 X |
| 5,407,512 | 4/1995 | Policht | 281/44 X |

FOREIGN PATENT DOCUMENTS

| | | |
|---|---|---|
| 334252 | 9/1989 | European Pat. Off. . |
| 2257193 | 8/1975 | France . |
| 2684641 | 6/1993 | France . |
| 2127442 | 12/1972 | Germany . |

*Primary Examiner*—Willmon Fridie, Jr.

*Attorney, Agent, or Firm*—Baker, Donelson, Bearman & Caldwell

[57] ABSTRACT

A container for a stack of paper which is provided with a large opening on one side to expose the top sheet of paper for writing or sketching. The opening defines a predetermined frame for providing the writing with a uniform margin. The edges of the opening discourage writing beyond the frame onto any support surface on which the container may be placed, such as a table or carpet.

11 Claims, 3 Drawing Sheets

CONTAINER FOR NOTEPAPER

BACKGROUND OF THE INVENTION

The present invention relates to the field of boxes and containers for writing paper or notepads, and more particularly, to a container for writing paper having an opening which defies a predetermined frame for the writing paper.

Typically, when preparing letters and other handwritten correspondence, it is desirable to provide uniform margins around the written material so that the letter has a neat and pleasing appearance. Likewise, when preparing sketches or drawings for business or similar situations, a neat and uniform border is desirable to enhance the professional appearance of the presentation. However, when writing or drawing on unruled paper, it is difficult to accurately and consistently gauge uniform distances from each edge of the paper. Similarly, children often are produced with notepaper for writing and drawing in situations in which it is not desirable for them to write on the table, carpet or other support upon which the paper is placed. In addition, much handwritten correspondence and sketching takes place while travelling or in a location away from a desk or other suitable support for writing. Most boxes or containers for notepaper and sketch paper do not provide adequate support for writing under such circumstances.

Accordingly, a need continues to exist for a simple, inexpensive device which provides a uniform margin around handwritten notes or sketches. A need also exists for a device which will prevent children or others from inadvertently writing beyond the edges of the paper onto the surface supporting the paper. Further, a need exists for a device which protects the paper from unwanted markings and which serves as a support for the paperwhen writing or sketching away from a desk or other support surface.

SUMMARY OF THE INVENTION

The present invention satisfies these needs by providing a box or container for notepaper or sketching paper which has substantially the same shape as the paper contained within the box. One surface of the box is provided with an opening having a perimeter which is smaller than the perimeter of the sheets of paper contained within the box. The perimeter of the opening frames the top sheet of paper contained in the box and each of the sides of the top face which define the opening has a substantially equal width to provide a uniform margin around a letter or other correspondence written on the top sheet. In a preferred embodiment, the opening takes up more than ninety percent of the surface area of the first large face and the inner edges of the opening are parallel to the outer edges of the first large face. The sides of the top face which frame the top sheet of paper also discourage any undesirable writing beyond the perimeter of the opening and onto a support surface such as a table or carpet.

The paper container of the present invention may be made of plastic, cardboard, or any other suitable material. Preferably, the container, and particularly the large second face, is made of a material which is firm or rigid enough to serve as both a carrier and a support surface for the paper. Generally, individual sheets of paper are placed and held in the box without stapling, pasting or binding. Further, the container may be provided with a handle for ease in carrying and a detachable cover may be provided over the opening in the top face to protect the paper prior to use.

In one embodiment, the paper container of the present invention is a parallelepipedic box having a first large face and a second large face which is opposite the first large face. The first and second large faces have a top and a bottom edge of equal width and two side edges of equal length. The side edges of the first large face are connected to the side edges of the second large face by two solid parallel side faces of equal width. The bottom edges of the first and second faces are connected by a bottom face which is the same width as the side faces. The top edge of the second face may be provided with an extension or flap which can be folded over and removably inserted beneath the top edge of the first face to close the box. In an alternate embodiment, the said and end faces may be folded in an accordion-like manner so that the box can be expanded or compressed to maintain the first top sheet firmly against the top sheet of paper in the box, regardless of how many sheets of paper are contained in the box.

Preferably, the outer perimeter of the container is only slightly larger than the outer perimeter of the sheets of paper to be stored within the container. The first large face is provided with an opening having a perimeter which is smaller than the perimeter of the paper stored within the container. The second large face is formed as a solid sheet which serves to support the notepaper when writing or sketching. A third internal large face have a slot which opens to the outside of the box may be provided. The internal large face is of substantially the same length and width as the first and second large faces. The third internal large face is placed within the box adjacent to the first large face. A single sheet of paper may be placed between the first and third large faces when the user is ready to begin writing.

BRIEF DESCRIPTION OF THE DRAWINGS

These and other features, aspects, and advantages of the present invention will become better understood when referring to the following description, appended claims, and accompanying drawings where:

DETAILED DESCRIPTION

Figure 1:
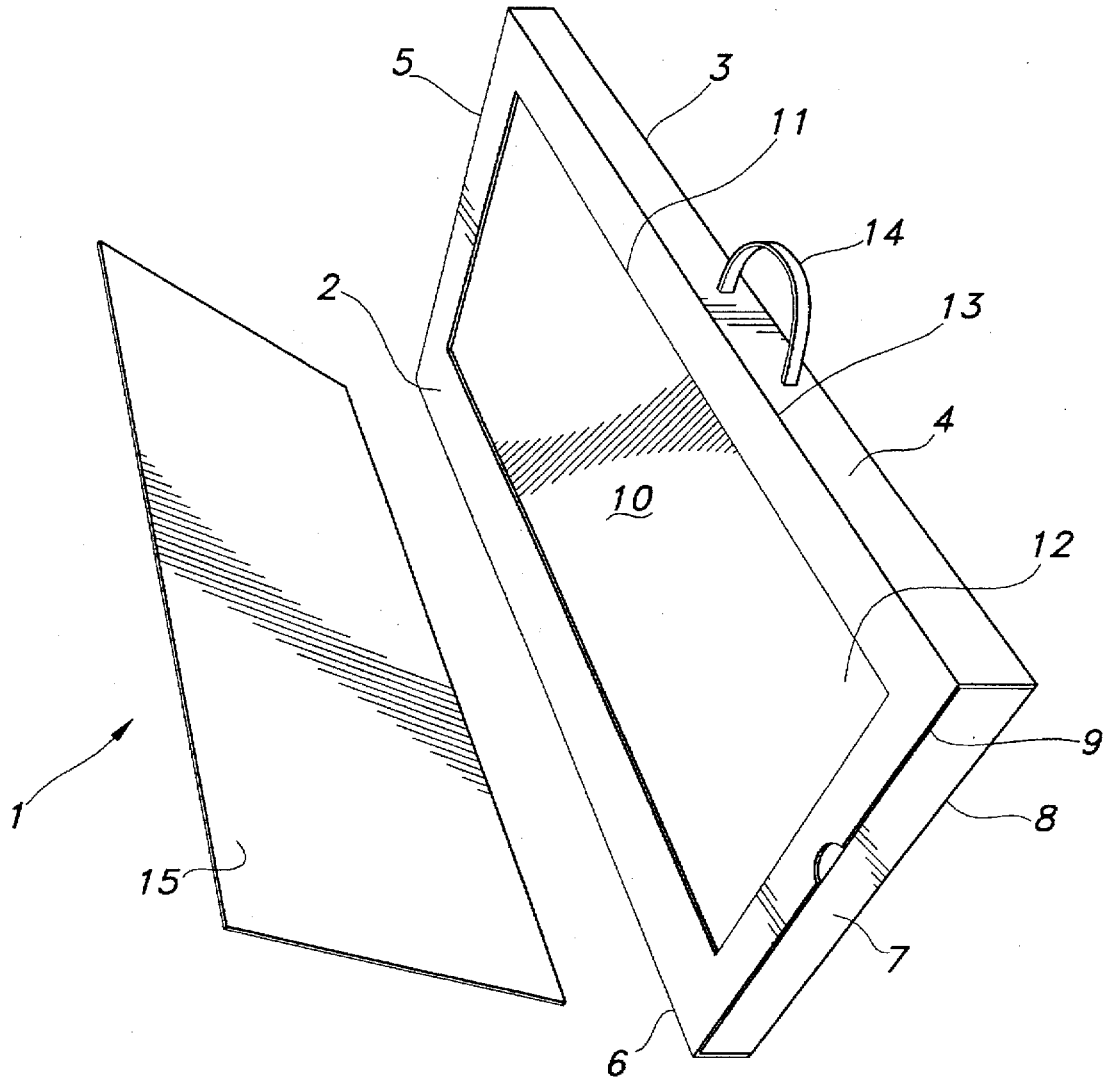
FIG. 1 is an exploded perspective view embodying features of the paper container of the present invention.

Referring now to FIG. 1, the paper container 1 of the present invention may be a parallelepipedic box having a first large face 2 and a second large face 3. The second large face 3 is opposite the first face 2. The edges of the first face 2 and the second face 3 are enclosed on three sides by solid side faces 4, 5 and 6, respectively. A side face 7 extends from the unenclosed edge 8 of second large face 3. The side face 7 can be folded under the corresponding edge 9 of large side face 2 to enclose and retain sheets of paper 10 within the container 1. Preferably, the sheets of paper 10 are approximately the same size as the first and second large faces 2 and 3. In a particularly preferred embodiment, the sheets of paper 10 are unbound and are retained in the paper container 1 as a stack. The side face 7 can be unfolded to allow insertion or removal of a single sheet or a stack of the paper 10.

The inner edges 11 of the first large face 2 define an opening 12 which allows access to the surface of a sheet of paper 10 retained within the container 1. Preferably, the opening 12 takes up more than ninety percent of the surface area of the first large face 2. However, opening 12 can be of any size which allows access to the top sheet of paper 10 within the container 1. The inner edges 11 of the first large face 2 are generally parallel to the outer edges 13 of the first large face 2 to provide a uniform margin around the sheet of paper 10. A letter or other writing on a sheet of paper 10 exposed by opening 12 will have a uniform margin which provides the written material with a neat and pleasing appearance. The edges 11 of the first large face 2 also serve to discourage writing off of the paper 10 and onto a supporting surface on which the container 1 may be resting. Thus, a child drawing on the sheet 10 within the space defined by the opening 12 will encounter the obstacle of the edges 11 and be encouraged to stop drawing before reaching the table, carpet, or other support on which the container 1 is placed.

The paper container 1 may be constructed in a variety of sizes to accommodate any size sheet of paper or any size stack of paper. In an alternate embodiment, the side faces 4, 5, and 6 may be folded in a accordion-like fashion. The folded sides can be expanded and compressed so that the writing frame defined by the opening 12 in the first large face 2 is applied tightly against the uppermost sheet of paper in the stack within the container 1, regardless of the size of the stack. Optionally, the paper container 1 may be provided with a handle 14 on one of the side faces 4, 5, or 6 for ease in carrying the container 1. Preferably, the handle 14 extends from one of the side faces 4 or 5. Typically, there is enough friction between the sheets of paper 10 and the container 1 to prevent the paper 10 from slipping out during transport. Further, the opening 12 in the paper container 1 may be covered with a panel 15 which can be detached along the edges 11 by means of a perforated tear line prior to the first use of the container 1.

In another embodiment, one of the side faces 4, 5, or 6 of the container 1 may be provided with an internal large face (not shown) which is positioned within container 1 adjacent to the first large face 2. The internal large face may be provided with a slot through which paper sheets may slide, one by one. Alternately, one of the side faces 4 or 5 may extend into the container 1 to form a dividing plate (not shown) which forms two compartments within the container 1. One of the compartments may be open to the outside through the opening 12 to expose a sheet of paper for writing and the other compartment can be used to file or store the sheets of paper.

Figure 2:
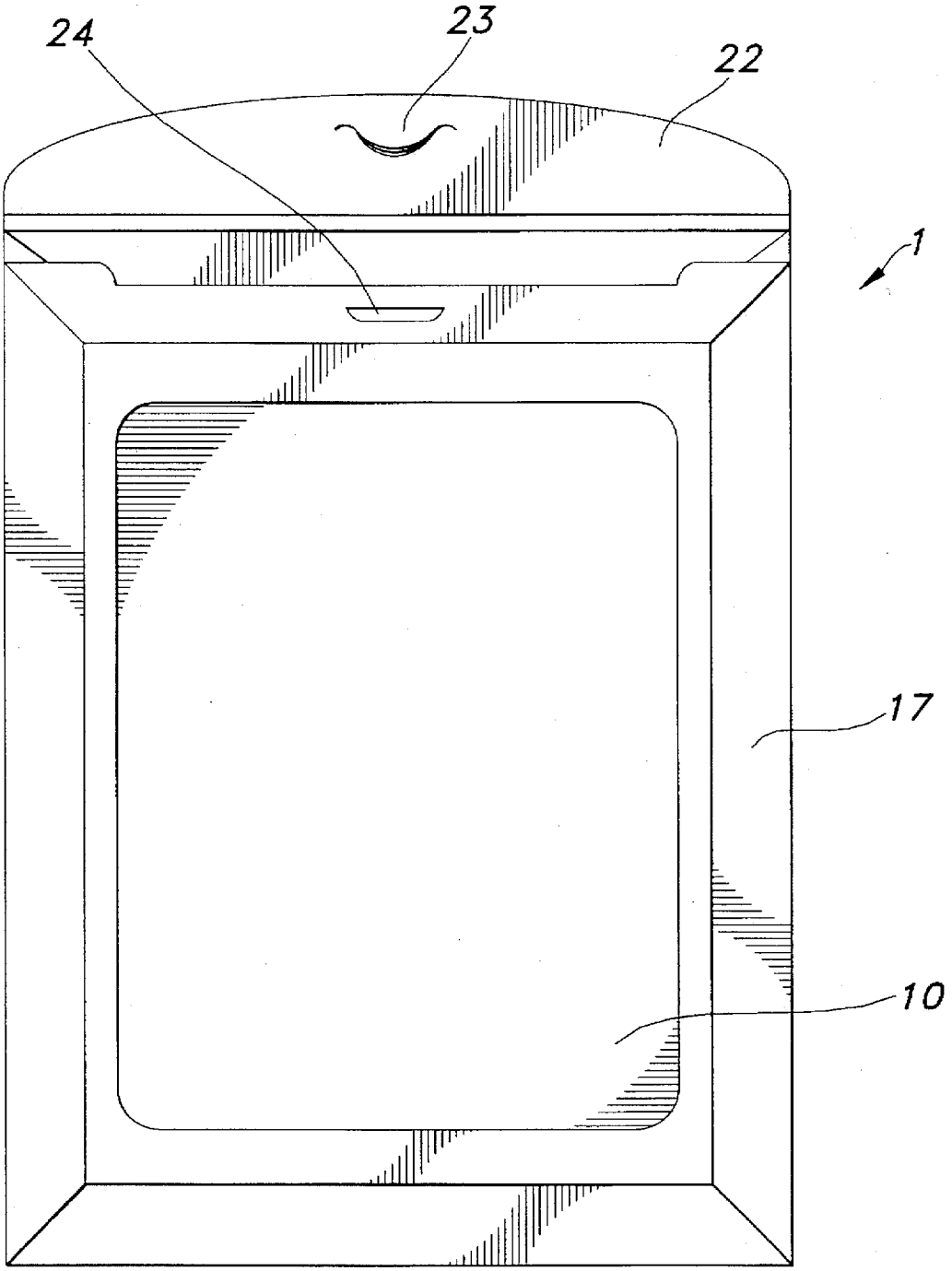
FIG. 2 is a front view showing features of an alternate embodiment of the paper container of the present invention.
Figure 3:
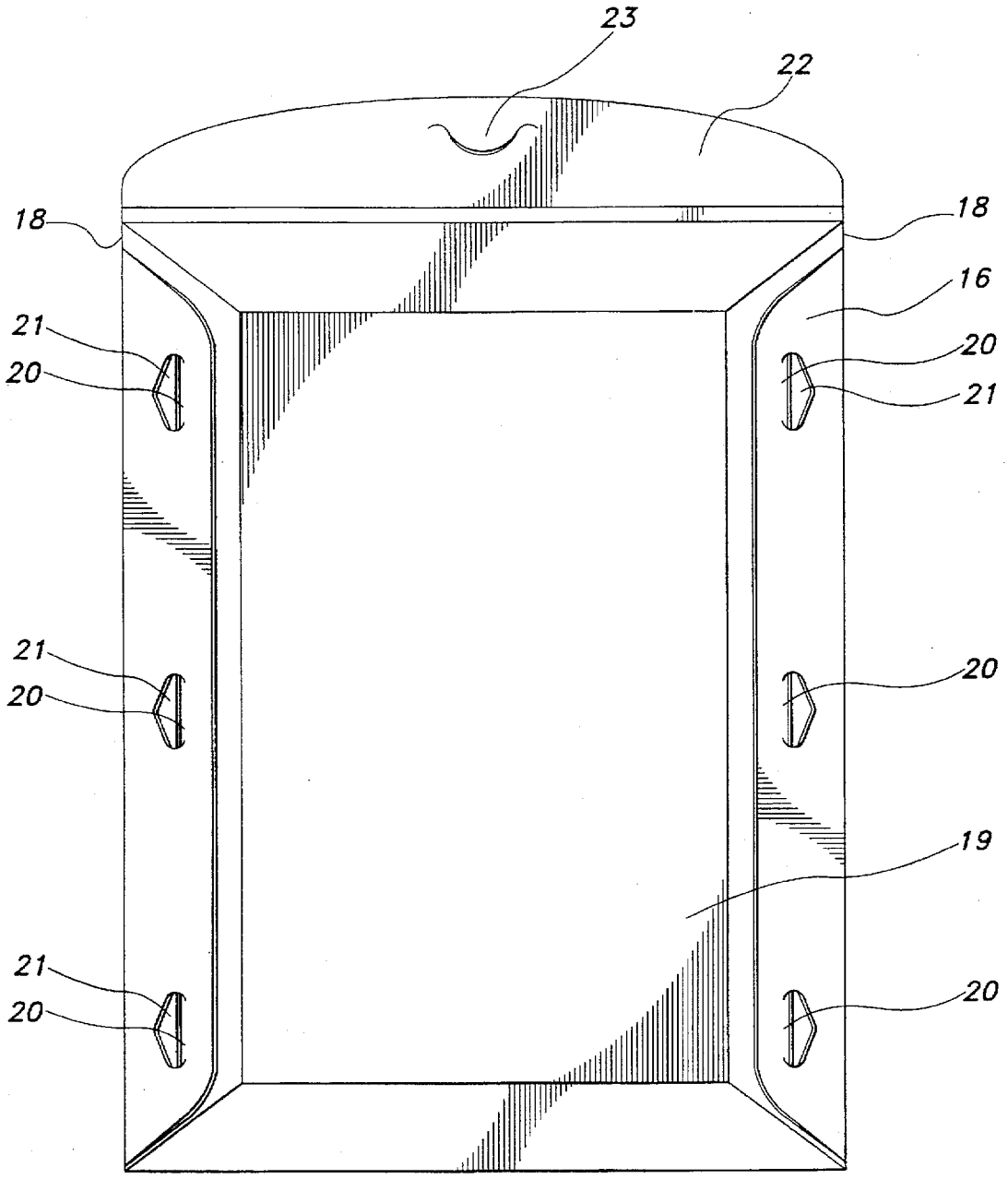
FIG. 3 is a back view of the paper container shown in FIG. 2.

FIGS. 2 and 3 illustrate yet another embodiment of the container 1 of the present invention, which may be formed from a single sheet of polypropylene or any other suitable material. As shown in FIG. 3, the side edges 16 are formed as extensions of the first large face 17. The side edges 16 are folded over the edges 18 of the large second face 19. The edges 16 are provided with tabs 20 which are inserted into corresponding slots 21 positioned along the edges 18 of second face 19. One end of the second large face 19 may be provided with a flap 22 which is folded over the corresponding edge of the first large face 17. The flap 22 is provided with a closure tab 23 which is inserted in a closure slot 24 to secure the paper within the container 1.

Although the invention is described with respect to the preferred embodiments, it is expected that various modifications may be made thereto without departing from the spirit and scope of the invention. Therefore, the scope of the invention is to be determined by reference to the claims which follow.

What is claimed is:

1. A container for paper which comprises:

a substantially flat large top face having a top edge, a bottom edge, two side edges and a continuous inner edge, said continuous inner edge defining an opening in the top face which exposes and frames a sheet of paper retained within the container;

a substantially flat large bottom face having a top edge, a bottom edge, and two side edges, the bottom and side edges of said top and bottom faces being connected by three side faces to form an enclosure for said paper, the perimeter of the edges of said top and bottom faces being substantially the same as the perimeter of the edges of the paper being enclosed within the container, and said side faces being disposed outwardly away from the edges of the top and bottom faces, each of said side faces having a longitudinally outwardly hinged foldline positioned between the edges of the top and bottom faces to allow the container to expand and compress according to the amount of paper retained within the container; and an end face connected to the top edge of one of said top and bottom faces in such a manner that the end face is openable to allow insertion and removal of the notepaper and closable to retain the notepaper within the container.

2. The container of claim 1 wherein said opening exposes and frames at least ninety percent of the surface area of said sheet of notepaper.

3. The container of claim 1 wherein said continuous inner edge defines an opening having sides which are substantially parallel to the outer edges of said large top face.

4. The container of claim 1 which further comprises a handle for carrying the container, said handle being attached to one of said side faces.

5. The container of claim 1 wherein said paper is in the form of a stack of individual sheets.

6. The container of claim 1 wherein said top and bottom faces and said side and end faces form a parallelepipedic box having three side faces and one end face.

7. A container for paper which comprises:

a substantially flat large top face having a top edge, a bottom edge, two side edges and a continuous inner edge, said continuous inner edge defining an opening in the top face which exposes and frames a sheet of paper retained within the container;

a substantially flat large bottom face having a top edge, a bottom edge, and two side edges, the bottom and side edges of said top and bottom faces being connected by three side faces to form an enclosure for said notepaper;

an end face, said end face being connected to the top edge of said bottom face in such a manner that the end face is openable to allow insertion and removal of the notepaper and closable to retain the notepaper within the container; and a substantially flat panel which is substantially the same shape and size of the opening in said top face, said panel being detachably connected to the continuous inner edge of said top face along a perforated tear line which corresponds to the continuous inner edge of said top face.

8. A container for paper which comprises:

a substantially flat large top face having a top edge, a bottom edge, two side edges and a continuous inner edge, said continuous inner edge defining an opening in the top face which exposes and frames a sheet of paper retained within the container;

a substantially flat large bottom face having a top edge, a bottom edge, and two side edges, the bottom and side edges of said top and bottom faces being connected by three side faces to form an enclosure for said notepaper;

an end face, said end face being connected to the top edge of said bottom face in such a manner that the end face is openable to allow insertion and removal of the notepaper and closable to retain the notepaper within the container; and a substantially planar dividing plate which is substantially the same size and shape of said top and bottom faces, said dividing plate being positionable within said container to form two separate compartments within said container.

9. The container of claim 1 wherein said container is formed from a single sheet of material.

10. The container of claim 7 wherein said container is formed from a single sheet of material.

11. The container of claim 8 wherein said container is formed from a single sheet of material.

* * * * *